US005777279A

United States Patent [19]

Parker et al.

[11] Patent Number: 5,777,279

[45] Date of Patent: Jul. 7, 1998

[54] SOUND ATTENUATING STRUCTURE

[76] Inventors: Murray M. Parker, Newport RR#1, Hants County, Nova Scotia, Canada, B0N 2A0; Arthur J. Hustins, Jr., 1550 Bedford Highway #220, Bedford, Nova Scotia, Canada, B4A 1E6

[21] Appl. No.: 567,595

[22] Filed: Dec. 5, 1995

[51] Int. Cl.[6] ..... G10K 11/00

[52] U.S. Cl. ..... 181/287; 181/290

[58] Field of Search ..... 181/284, 287, 181/290, 294, 295; 49/501

[56] References Cited

U.S. PATENT DOCUMENTS 3,273,297 9/1966 Wehe, Jr. ..... 181/287
3,506,088 4/1970 Sherman ..... 181/287
4,924,969 5/1990 L'Heureux ..... 181/290
5,417,029 5/1995 Hugus et al. ..... 49/501 X

*Primary Examiner*—Khanh Dang
*Attorney, Agent, or Firm*—Choate, Hall & Stewart

[57] ABSTRACT

Sound attenuating structure. The structure includes spaced apart first and second stiffened metal panels connected through a spring connection to form a sealed cavity therebetween. The stiffened panels include a geometric grid pattern of stiffening members forming triangular areas selected to eliminate panel resonances below approximately 1500 Hz. A sound attenuating material is disposed within the cavity to dampen higher frequency resonances. In one embodiment, the structure includes a septum disposed between the first and second metal panels. A preferred sound attenuating material disposed within the cavity is rock wool.

14 Claims, 13 Drawing Sheets

| Frequency (Hz) | Transmission Loss (dB) |
|---|---|
| 100 | 26 |
| 125 | 28 |
| 160 | 37 |
| 200 | 48 |
| 250 | 51 |
| 315 | 53 |
| 400 | 54 |
| 500 | 54 |
| 630 | 60 |
| 800 | 67 |
| 1000 | 71 |
| 1250 | 74 |
| 1600 | 78 |
| 2000 | 78 |
| 2500 | 78 |
| 3150 | 81 |
| 4000 | 82 |
| 5000 | 84 |
| 6300 | 84 |

STC 52

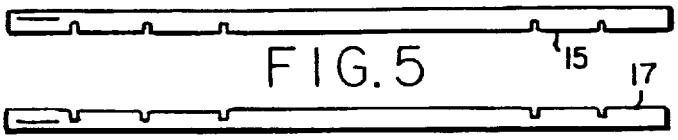
FIG. 5
FIG. 6
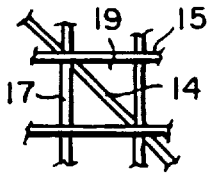
FIG. 7
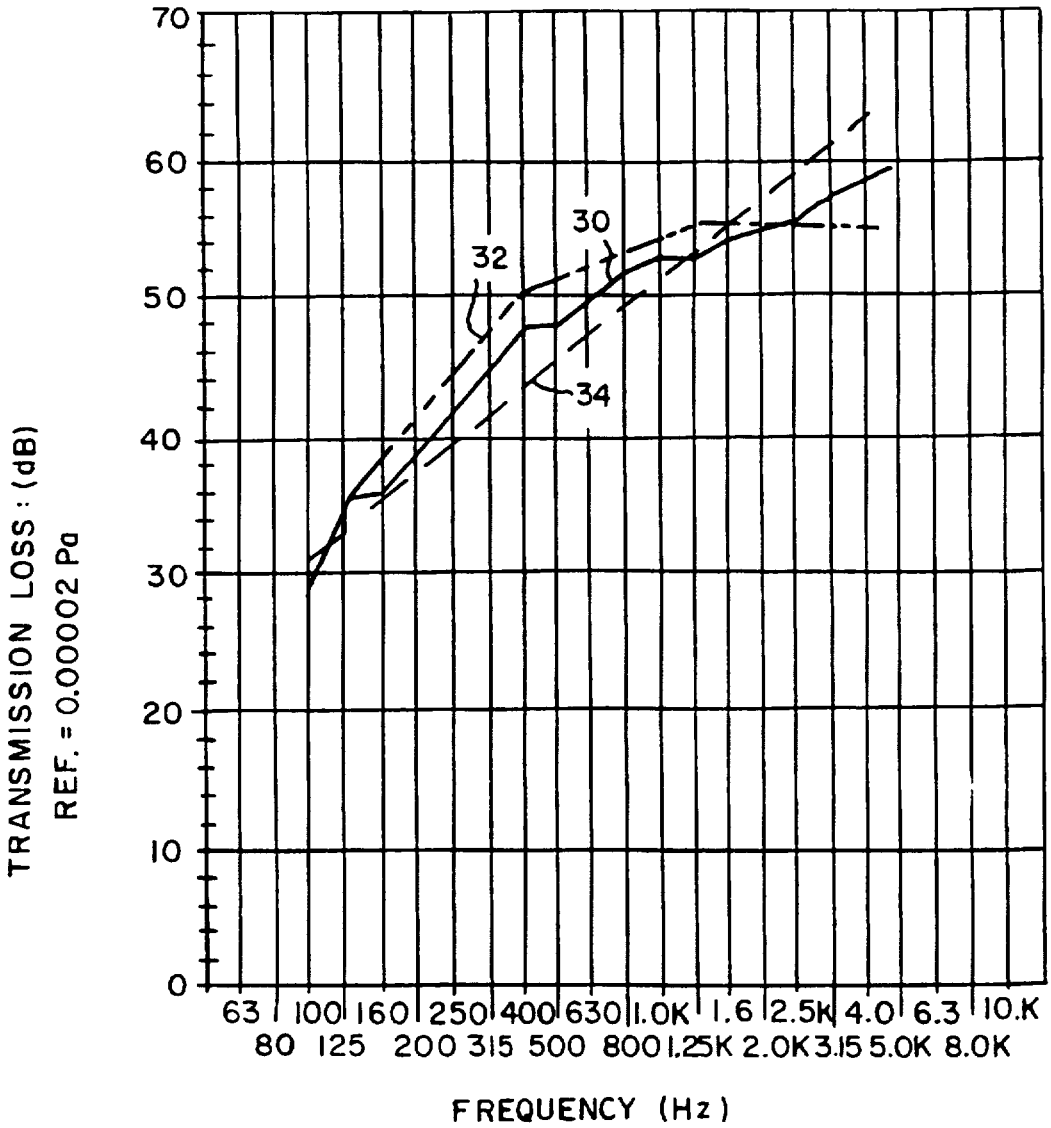
FIG. 8

SOUND ATTENUATING STRUCTURE

BACKGROUND OF THE INVENTION

This invention relates to sound proof structures such as doors and partitions which reduce the level of sound transmitted therethrough.

Sound attenuating doors and partitions are desirable in many circumstances and essential in numerous other situations. Examples are radio and television studios and auditoria. Current building codes also mandate higher degrees of soundproofing with respect to multiple dwellings and condominiums. Many designs are known for producing sound attenuating structures. Prior art sound attenuating structures typically include a pair of spaced apart panels filled with a sound absorbing material. Oftentimes, one or more internal septa are provided which heretofore have usually been made of environmentally hazardous materials such as lead. Sometimes bracing has been included between one or both of the outer panels and the internal septum. See, for example U.S. Pat. Nos. 3,319,738; 3,295,273; 3,273,297; and 3,221,376. See also, Canadian Patent Nos. 723,925; 744,955; 928,225; 817,092; 851,003; 858,917; and 915,585.

A usual method of obtaining a satisfactory sound transmission class rating is to provide an inert mass which intercepts the sound and thus acts as a barrier which obeys the simple law of acoustical physics known as the "mass law." This law provides the maximum sound transmission loss for a given mass per unit area but it is only obeyed provided that the mass (of a partition or door) is inert, i.e., free from mechanical resonances, at all frequencies which might be present in the sound waves. This inert condition can be obtained provided that the mass has little or no elasticity because otherwise it would resonate at certain frequencies and consequently transmit sound selectively at these frequencies. As stated above, such a prior art design for a door is that in which a lead septum is placed between front and rear door surfaces. Because the front and rear door surfaces may flex, an absorbing material of a fibrous nature is put into the interior of the door to damp the motion of the air. In this way, further sound attenuation beyond that obtained by the use of the lead septum is achieved.

SUMMARY OF THE INVENTION

The sound attenuating structure according to one aspect of the present invention includes spaced apart first and second stiffened metal panels connected to one another through a spring connection to form a sealed cavity therebetween. A sound attenuating material is disposed within the cavity between the first and second stiffened panels. In one embodiment, a septum is disposed between the first and second metal panels. It is preferred that the septum be made of a metal material. The septum may also comprise a metal plate flanked by wall board material such as gyprock. It is also preferred that the sound attenuating material within the cavity be a non-continuous, porous material such as a rock wool insulation material.

It is preferred that the stiffened metal panels include a steel plate to which are affixed stiffening steel elements disposed in a geometric grid pattern such as a pattern comprising squares or rectangles connected along a diagonal to create triangular areas. It is preferred that the stiffening elements and their arrangement be selected to limit panel resonances to frequencies above approximately 1500 Hz. The geometric grid pattern on one of the stiffened panels is rotated with respect to the grid pattern on the other stiffened plate to provide different resonant frequencies for the two panels at higher frequency ranges (i.e., above approximately 1500 Hz.). A preferred amount of rotation is 90°.

A suitable material for connecting the spaced apart first and second panels through a spring connection is silicone such as a fire stop silicone. The structure of the invention may further include end plates disposed between the first and second metal panels and connected to the first and second metal panels through a spring connection. The stiffened metal plates and all other internal surfaces may be coated with a vibration damping material such as GP-1 Vibration Damping Compound as an aid to controlling resonances at higher frequencies.

In another aspect of the invention a sound attenuating door includes spaced apart first and second metal panels stiffened by elements disposed in a geometric grid pattern affixed to the panels, the panels connected through a spring connection to form a sealed cavity therebetween. In this aspect, a septum is disposed between the first and second metal plates and a sound attenuating material is disposed within the cavity. To this structure is added the necessary hardware such as handles, hinges, locks, etc., to form a door.

The design of the present invention thus substantially achieves the effect of an inert mass in that the sound absorbent structure is effectively non-resonant over the range of frequencies utilized in testing protocols which are used to determine the sound transmission class of a structure. The design of the present invention uses the mass in the structure to its maximum effect so that the structure is relatively light for the sound insulation it produces and it does not require the use of lead or other environmentally hazardous materials.

The structures of the invention are reinforced by a framework of stiffening members which raise the fundamental resonant frequency of the free part of the panels to the region of 1,500 Hz or higher. The fundamental and higher resonances are damped to reduce the quality factor of the vibration to a small number approximating to unity by the use of a visco-elastic coating on the inner face of the panel.

The preferred geometric grid pattern constitutes triangular regions on the stiffened metal panels created by the use of diagonal stiffening pieces. As will be described in more detail hereinbelow, a mathematical study using numerical methods has been performed to establish the largest free triangular panel area which may be created within a reinforcing so that low frequency resonances do not occur. By using the largest triangular areas, the overall mass of the door is reduced while still assuring no resonances below approximately 1500 Hz.

In order that the quality factor of the fundamental and higher order resonances of the triangular areas are at or close to unity, a viscous damping material is applied to the panel surfaces in sufficient quantity. Such material responds to motion by producing a damping force which degrades the motion and causes a slight heating of the visco-elastic materials. Many materials may be used for this purpose and the choice of material is influenced by its cost. The damping effect may be enhanced by laying a thinner metal plate on the free surface of the damping material.

The construction of the sound attenuating structures of the present invention provides for an effectively stiff structure because at lower frequencies (less than approximately 1500 Hz) it is non-resonant and at higher frequencies the resonant frequencies of the two outer panels are different because the grid panel of one is rotated (such as by ninety degrees) to the grid pattern of the other. Further, the resonant vibration of the panels at higher frequencies (greater than approximately 1500 Hz) is sufficiently damped by a viscous or visco-elastic layer on the inner metal panel surfaces. Attenuation of sound transmission at higher frequencies is also achieved by the presence of fibrous sound absorbing material within the space between the panels. Thus, low frequency resonances are eliminated by the selection of the geometric grid pattern which stiffens the outer panels and high frequency resonances are damped by the combination of (1) different resonant frequencies for the opposing panels, (2) a non-continuous, porous material between the panels, and (3) a viscous or visco-elastic layer on the inner surfaces of the structure.

BRIEF DESCRIPTION OF THE DRAWING

FIGS. 5 and 6 are cross-sectional views of slotted stiffening members forming the intersecting stiffening elements.

FIG. 7 is a cross-sectional view showing diagonal elements in the grid pattern.

FIG. 8 is a graph of transmission loss versus frequency for a sound transmission class 51 structure.

DESCRIPTION OF THE PREFERRED EMBODIMENT

The theory on which the present invention is based will now be described. As discussed above, conventional sound attenuating structures seek to create an inert mass which intercepts sound and acts as a barrier which obeys the acoustical law known as the "mass law." This law provides the maximum sound transmission loss for a given mass per unit area but it is only obeyed provided that mass is inert, i.e., free from mechanical resonances at all frequencies which might be present in the acoustical waves. Conventional sound attenuating structures attempt to mimic an inert mass by incorporating a massive lead septum to provide the inert mass characteristic. Such structures are heavy and pose the risk of environmental damage because of the use of the heavy metal lead.

The inventors herein have recognized that an alternative method of substantially obtaining an "inert mass" is possible by stiffening otherwise resonant structures in a way to damp certain frequency ranges. In particular, numerical techniques were undertaken to determine the largest free triangular area which can be created within a substantially rectangular structure to eliminate resonances in a desired range of frequencies, for example, to eliminate resonances at lower frequencies such as less than approximately 1500 Hz. By finding the largest triangular area while providing elimination of resonances, the amount of stiffening material can be reduced resulting in an overall lighter structure. The preferred mathematical techniques for determining triangle size are included in the Mathematical Analysis section of this specification. An exemplary structure according to the invention will now be described.

Figure 1:
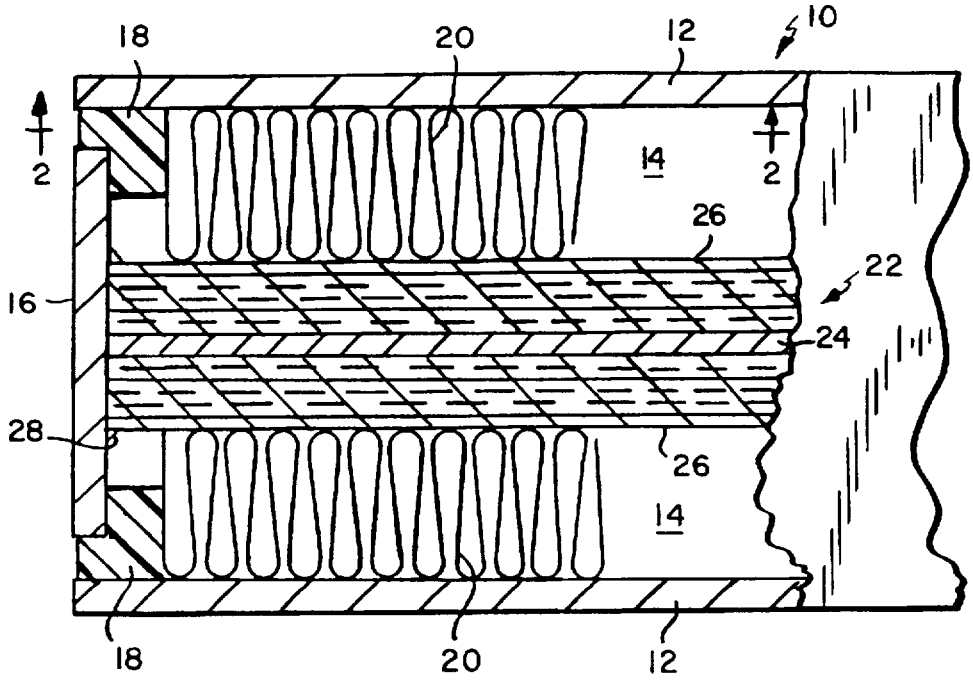
FIG. 1 is a cross-sectional view of the sound attenuating structure of the invention.
Figure 2:
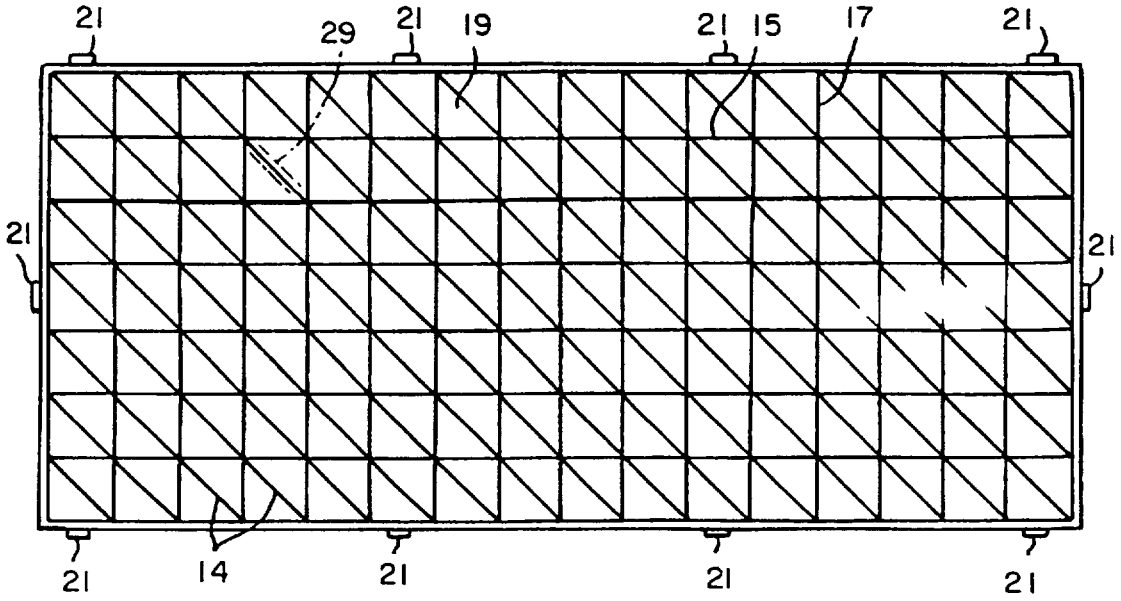
FIG. 2 is a cross-sectional view of the structure of FIG. 1 taken along the direction A—A.

With reference first to FIGS. 1 and 2, a sound attenuating structure 10 includes outer skin panels 12 which are preferably steel, such as 14 gauge steel plate. On the inside surfaces of each of the outer skin panels 12 are welded steel bars 14, 15 and 17. Suitable bars 14, 15 and 17 are ½ inch by ⅛ inch steel plate. The bars 14, 15 and 17 are welded on edge onto the outer skin panels or plates 12 in a pattern such as that shown in FIG. 2. It is preferred that the bars 14, 15 and 17 be welded onto the plates 12 to 80% strength. The bars 14, 15 and 17 serve to stiffen the plates 12 and to limit resonances to frequencies above approximately 1500 Hz. Members 14, 15 and 17 may also be constructred of ½ inch by ½ inch steel tubing of ⅛ inch thickness to increase rigidity of the structure.

With reference to FIG. 2, horizontally disposed bars 15 and vertically disposed bars 17 are slotted as shown in FIGS. 5 and 6 and are assembled and welded to the outer skin 12. The diagonal pieces 14 are then welded in place as seen in FIG. 7. This process creates the triangular regions 19 whose size is preferably determined by using the mathematical procedures set forth in the Mathematical Analysis section of this specification. It is important to note that the diagonal members 14 of a first panel 12 are rotated with respect to the second of the panels 12 (not shown) so as to cause the resonant frequencies of the two panels 12 to be different. The rotation may be 90°. In the exemplary structure of FIG. 2, horizontal members 15 are approximately 7 feet, 10¾ inches long with 5 inches between slots. Vertical members 17 are approximately 3 feet, 10⅞ inches long also with 5 inches between slots resulting in diagonal members 14 being approximately 6¹¹⁄₁₆ inches long.

With reference again to FIG. 1, the panels 12 are affixed to an end plate 16 through a resilient material 18. A suitable end plate 16 is ³⁄₁₆ thick steel plate having a width of approximately 3 inches. The overall structure will have a thickness of just over 3.5 inches with one-quarter inch spaces between the end plate 16 and the outer skin panels 12. The one-quarter inch spaces are filled with the resilient material 18. This thickness is entirely exemplary, however. A suitable resilient material 18 is fire stop silicone. In addition, the outer skin panels 12 are held together by side pieces (not shown) which are welded at a few strategically placed points. These points are shown in FIG. 2 at locations 21. The strategically placed welds 21 connect one of the outer skin panels 12 to the other of the outer skin planes 12 so that they remain connected through a spring connection by the resilient silicone material. Further, as noted above, the grid pattern in one of the outer skin plates 12 is rotated with respect to the other of the outer skin plates 12.

A sound attenuating material 20 is disposed within the cavity created between the steel panels 12. It is preferred that the sound attenuating material 20 be a porous material such as rock wool insulation. The sound attenuating material 20 may fill the entire cavity between the plates 12 or only a portion of it as shown in FIG. 1. The inner surface of the panels 12 and exposed surfaces of stiffening bars 14, 15 and 17 should preferably be coated with a viscous or visco-elastic layer 29 such as GP-1 Vibration Damping Compound available from Soundcraft of Deer Park, N.Y. A septum 22 may be disposed in the central portion of the cavity. In this embodiment, the septum 22 includes a steel plate 24 flanked by a wall board material 26 such as ⅜" thick gyprock. The gyprock is glued to the plate 24 using any suitable adhesive such as Lepage's all purpose glue. A suitable thickness for the plate 24 is ⅛". The plate 24 is welded to the end plate 16 all around the edge of the plate 24 to form a tee section with the end plate 16 before the gyprock is glued on. Latex caulking 28 is then applied as shown in the figure. A second end plate (not shown) completes the structure.

Figure 3:
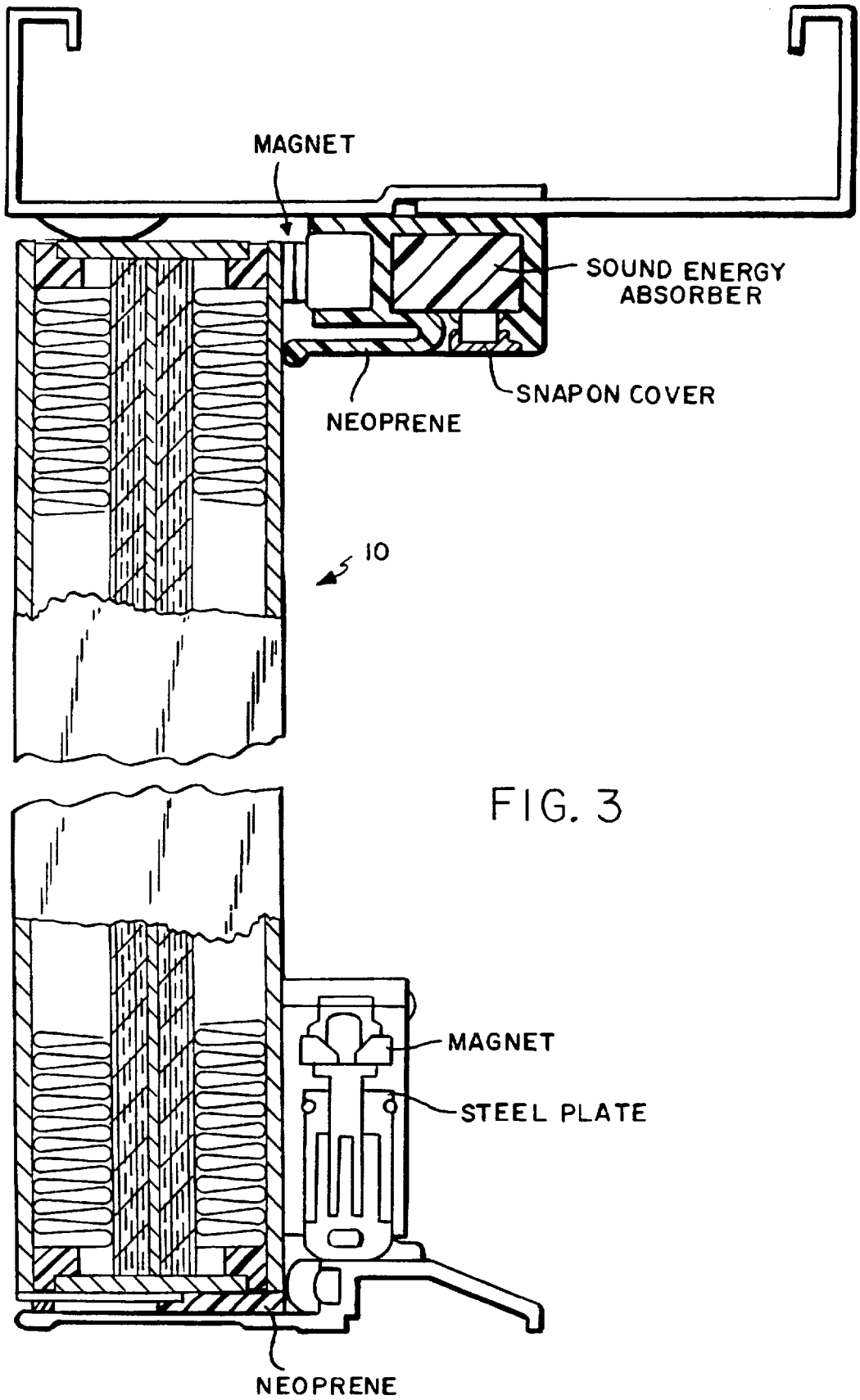
FIG. 3 is a cross-sectional view of the sound attenuating structure of the invention configured as a door.

The sound attenuating structure 10 of the invention is shown configured in a door embodiment in FIG. 3 which illustrates typical door seals to provide additional sound energy absorption. A typical sound absorbing structure utilized as a standard door has dimensions of approximately 2'11"by 6'9". The foregoing description is by way of example only and the sound attenuating structure of the invention may be made to any desired size.

The combination of the stiffening bars on the outer skin plates 12 and the resilient connection to create a cavity results in a structure having superior sound attenuating characteristics. The unique pattern of the stiffening bars contributes to the overall sound attenuating characteristics of the structure of the invention.

EXAMPLE 1

As is well known in the practice of noise control, sound pressure level (SPL) is measured in decibels (reference to 20 micro-Pascals) and frequency is measured in Hz (cycles per second). Thus, in describing a panel 10 for noise suppression, a graph can be utilized which plots the decibel reduction of the panel against frequency. It is common practice to utilize standard measurement techniques defined by such organizations as the American Society for Testing and Materials (ASTM) to obtain a representative performance number for the panel. Typically, this representative number is the ASTM sound transmission class (STC) which classifies the panels in terms of a standard curve which is defined by its sound reduction at 500 Hz. Thus, a STC 40 curve permits 1/10,000 (40 decibels) of the incident sound to be transmitted at 500 Hz. As will be described below, a sound attenuating door structure made according to the principals of the present invention has been tested and compared with an STC 52 curve which is a 52 decibel diminution of transmitted sound.

Airborne sound transmission loss tests were performed on a door panel constructed in accordance with the embodiment shown in FIG. 1. The door panel measured 2.05 meters by 0.89 meters by 76 millimeters and weighed 180 kilograms. The specimen was mounted in a filler wall built in a 3.1 meters by 2.4 meters test frame. The perimeter of the door panel was covered on the source side with two layers of 16 millimeters gypsum board. On the receiving side, two layers of 16 millimeters gypsum board and two layers of 16 gauge steel covered the door panel perimeter. Approximately 25 millimeters of the door panel around the perimeter was covered. The exposed area of the door panel was therefore 1.65 square meters. The door panel was sealed around the perimeter with latex caulking and metal tape.

At the outset of the testing, the filler wall was measured for transmission loss with the supporting structures for the test specimen in place but without the test specimen. For this test the opening in the filler wall was finished in the same construction as the rest of the filler wall.

Tests were conducted in accordance with the requirements of ASTM E90-90 Standard Method for Laboratory Measurement of Airborne Sound Transmission Loss of Building Partitions, and of International Standards Organization ISO) 140/III 1978(E), Laboratory Measurement of Airborne Sound Insulation of Building Elements. The sound transmission class was determined in accordance with ASTM Standard Classification E413-87. The Weighted Sound Reduction Index was determined in accordance with ISO 717, Rating of Sound Insulation in Buildings and of Building Elements, Part I: Airborne Sound Insulation in Buildings and of Interior Building Elements.

The volume of the source room was 65 cubic meters. The volume of the receiving room was 250 cubic meters. Each room had a calibrated Bruel & Kjaer condenser microphone that was moved under computer control to nine positions. In addition to fixed diffusing panels, the receiving room also had a rotating diffuser panel.

Measurements were controlled by a desk top personal computer interfaced to a Norwegian Electronics 830 real time analyzer. One-third octave sound pressure levels were measured for thirty seconds at each microphone position and then averaged to get the average sound pressure level in the room. Five sound decays were averaged to get the one-third octave reverberation time at each microphone position in the receiving room. These times were averaged to get reverberation times for the room.

Results of the airborne sound transmission loss measurements of the sound attenuating structure according to the invention are given in Table 1 below and FIG. 4.

TABLE 1

| Frequency (Hz) | Sound Transmission Loss (dB) | 95% Confidence Limits | Deviation Below the STC Contour |
|---|---|---|---|
| 100 | 26c | ±2.7 | |
| 125 | 28c | ±1.1 | −8 |
| 160 | 37c | ±1.2 | −2 |
| 200 | 48c | ±0.9 | |
| 250 | 51c | ±0.7 | |
| 315 | 53c | ±0.5 | |
| 400 | 54 | ±0.5 | |
| 500 | 54 | ±0.5 | |
| 630 | 60c | ±0.4 | |
| 800 | 67c | ±0.4 | |
| 1000 | 71** | ±0.3 | |
| 1250 | 74** | ±0.3 | |
| 1600 | 78** | ±0.3 | |
| 2000 | 78** | ±0.3 | |
| 2500 | 78** | ±0.3 | |
| 3150 | 81** | ±0.2 | |
| 4000 | 82** | ±0.3 | |
| 5000 | 84** | ±0.3 | |
| 6300 | 84** | ±0.3 | |

Sound Transmission Class (STC) = 52

Weighted Sound Reduction ($R_w$) = 56 c At these frequencies, the measured transmission loss of the door panel specimen was corrected for transmission through the filler wall. The reported values are the corrected values. The corrections were done according to ASTM E90 draft standard (1994).

** At these frequencies, the measured transmission loss of the filler wall was not sufficiently above the measured transmission loss of the door panel specimen. The reported values are calculated lower limit transmission loss values of the door panel. The calculations were done according to ASTM E90 draft standard (1994).

Figure 4:
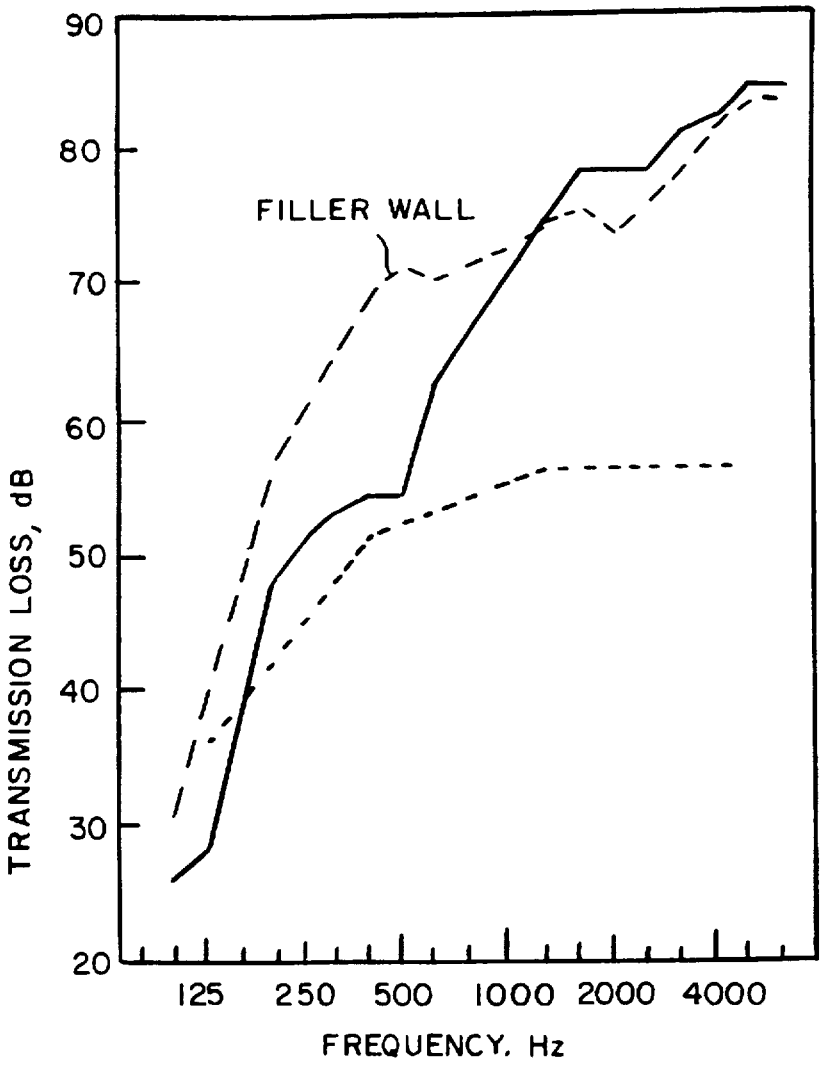
FIG. 4 is a graph of transmission loss versus frequency for structures of the invention.

The transmission loss results for the filler wall without the specimen in place are shown by the dashed line FIG. 4. The filler wall results have been normalized in the same area as the test specimen. When the measured transmission loss of the filler wall is more than 15 dB above the measured transmission loss of the specimen, the effect of the filler wall is negligible. Frequencies at which the filler wall transmission loss is less than 15 dB above the specimen transmission loss are noted in Table 1 above. At frequencies where the filler wall transmission loss is between 6 and 15 dB above the transmission loss through the specimen, the specimen transmission loss values have been corrected. At frequencies where the filler wall transmission loss is less than 6 dB above the transmission loss through the specimen, the transmission loss values cannot be corrected; however, a lower limit estimate of the transmission loss through the specimen is given in Table 1.

Referring again to FIG. 4, the solid line is measured data of transmission loss versus frequency through the sound absorbing structure of the invention. The dotted curve is the STC 52 contour. Note that the transmission loss for the sound absorbing structure of the invention exceeds that of the STC 52 contour for all frequencies above approximately 150 Hz.

EXAMPLE 2

A second test specimen had overall dimensions of 0.9 meters wide by 2.05 meters high and nominally 45 millimeters thick. The specimen was placed directly in an adapter frame and tested in a 1.22 meter by 2.44 meter test opening and sealed on the periphery (both sides) with a dense mastic. The specimen structure was a prefabricated panel consisting of two 14 gauge steel plate outer skins and a 14 gauge steel plate center septum. The outer skins were stiffened as described above with a geometric pattern of stiffening members. Both ends of the center septum were attached to a metal flat bar end plate. Both flat bar and end plates were attached to and isolated from the two outer skins by silicone fire stop/seal configuration. A layer of rock wool insulation was installed on each side of the septum and held in place by a 13 millimeter by 32 millimeter plate that provided an air space between the insulation and the outer skin. The weight of the specimen as measured was 139.9 kilograms resulting in an average of 77.3 kilograms per square meter. The transmission area used in the calculations for transmission loss was 1.81 meters squared. The source and receiving room temperatures at the time of the test were 22° C. and 55±3% relative humidity.

The measurements were made with all facilities and procedures in explicit conformity with ASTM designations E90-90 and E413-87, as well as other pertinent standards. The tests were performed by Riverbank Acoustical Laboratories, which is accredited by the U.S. Department of Commerce, National Institute of Standards and Technology (NIST) under the National Voluntary Laboratory Accreditation Program (NVLAP) for the test procedure. The microphone used was a Bruel and Kjaer Serial No. 1440522.

Sound transmission loss values were tabulated at 18 standard frequencies. The precision of the transmission loss test data are within the limits set by the ASTM Standard E90-90. FIG. 8 is a graph of transmission loss versus frequency for a sound transmission class (STC) of 51. In FIG. 8 curve 30 is the transmission loss of the structure according to the invention. Curve 32 is the STC 51 contour and curve 34 is a mass law contour.

Mathematical Analysis of Panel Vibration

The following analysis sets forth a methodology for determining maximum panel areas which can be used while eliminating resonances below a preselected frequency range.

The equations that describe the deflection of a vibrating elastic panel have been solved by a finite difference procedure for the cases in which the panel is either triangular or rectangular and is clamped along its edges. The numerical results are presented below.

The results are presented with reference to a parameter k which depends on the material of the panel, the panel thickness and the frequency of vibration. It is defined below. For a steel plate of half-thickness H cms some values of k are as listed in Table 2.

TABLE 2

Values of k for steel plate of half-thickness H at frequency f.

| | H = 0.01 cm | 0.05 cm | 0.1 cm | 0.2 cm |
|---|---|---|---|---|
| f = 250 HZ: | k = 0.27 | 0.0067 | 0.0027 | 0.00067 |
| 500 HZ: | 1.08 | 0.027 | 0.0108 | 0.0027 |
| 1 KHZ: | 4.31 | 0.108 | 0.0431 | 0.0108 |
| 1.5 KHZ: | 9.69 | 0.243 | 0.0969 | 0.0242 |
| 2 KHZ: | 17.24 | 0.432 | 0.172 | 0.0430 |

Table 2 may also be used for an aluminum plate provided the listed values of frequencies are multiplied by 1.03.

For several sizes and shapes of triangular panels the amplitudes of vibration of points chosen on a triangular grid have been computed for various values of k. The grids of points have been chosen to cover the cases in which each side of the triangular panel has either 12, 16, 20 or 24 grid points. This number is denoted by m.

The accuracy of the computation improves as m is increased. This is discussed further below.

For a panel of given dimensions and material, as the frequency is increased from a value of zero the value of k increases in a manner proportional to the square of the frequency, and at the first resonant frequency the computed deflection becomes infinite. Determination of this first resonant frequency is the prime concern of this analysis. The results are summarized in Table 3.

For each value of k listed in Table 3 the corresponding resonant frequencies for various panel thicknesses may be estimated from Table 2. For values not listed in Table 2 the resonant frequencies may be found from the equation $$f=H(k/0.00043)^{1/2}$$

In Table 3 the value of a is the length of the base of the triangular panel. The values of $\beta$ and $\gamma$ are the angles between the base and the two other sides of the panel. The listed values of k at resonance were obtained with m=20 and hence with 210 grid points. Each pair of k values, such as 0.011–0.012, indicates a range within which the resonant frequency is predicted when m=20.

Some computations have also been made with m=24, and hence with 300 grid points, but it is believed that choosing m=20 is sufficient for the present purpose. However it should be realized that each range, such as 0.011 –0.012 is that predicted by use of m=20 and that used of a higher value of m might give a slightly different range such as 0.0117–0.0122.

It may be noted that the resonant frequencies predicted by use of m=20 are likely to be less, not greater, than the exact values. It is therefore best to regard the higher value, such as 0.012, as the best prediction. Further discussion of the accuracy of the predictions is included below.

It may be of interest to compare the resonant frequencies of the various triangular panels with those of square panels. Some results for square panels are listed in Table 4. Since m is chosen as 12 the predictions should be regarded as less accurate than those for the triangular plates, but the accuracy is sufficient for purposes of comparison.

Figure 9:
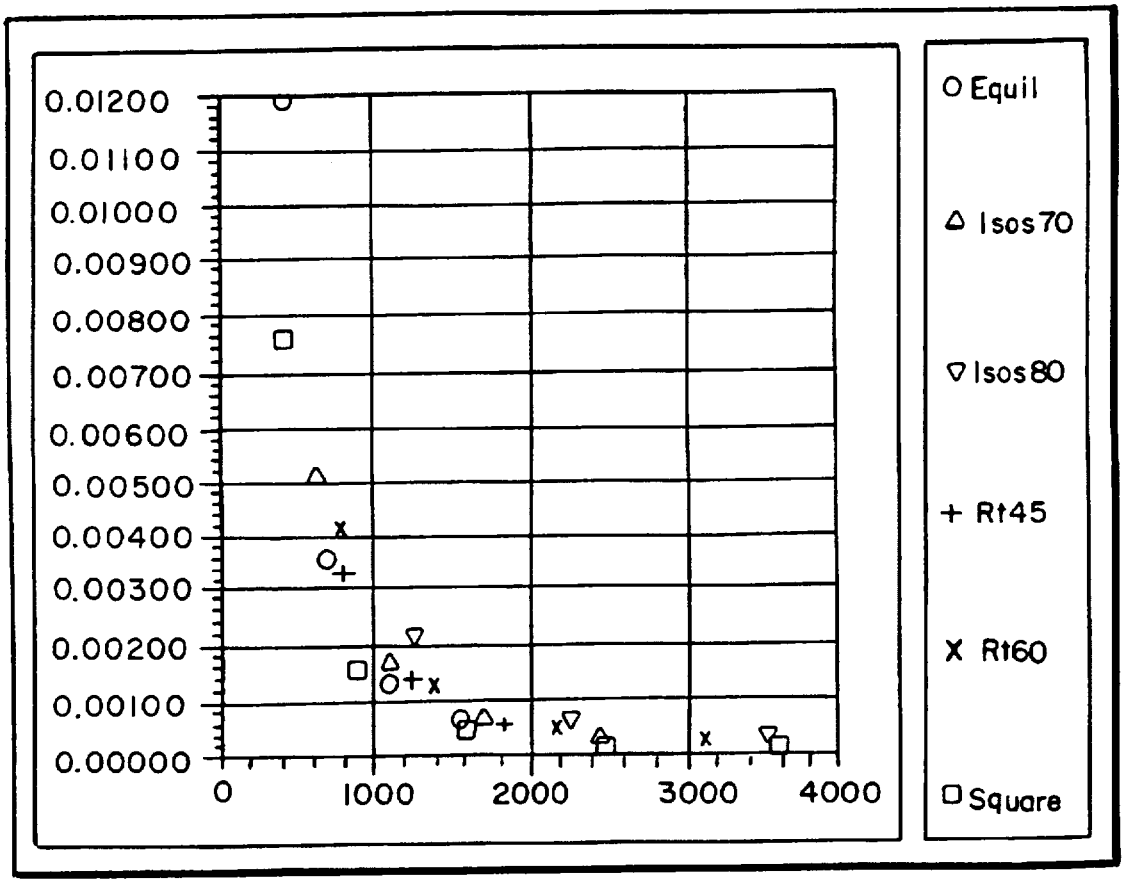
FIG. 9 is a graph of resonant frequency versus panel area for different shape panels.

For the various dimensions of panels listed in Tables 3 and Table 4 the first resonant frequency appears to be more dependent on the panel area than upon the shape of the panel. This is illustrated in FIG. 9 in which the horizontal scale represents the panel area and the vertical scale represents the resonant frequency.

TABLE 3

Predicted values of k at the first resonant frequency of a triangular panel when m = 20

| | k at resonance | Panel area |
|---|---|---|
| Equilateral Triangle: | | |
| a = 30 cms | 0.011–0.012 | 390 sq cms |
| 40 | 0.0035–0.0036 | 693 |
| 50 | 0.0014–0.0015 | 1083 |
| 60 | 0.00070–0.00071 | 1559 |
| Isosceles Triangle (β = 70°, γ = 70°); | | |
| a = 30 cms | 0.0050–0.0051 | 618 sq cms |
| 40 | 0.0016–0.0017 | 1099 |
| 50 | 0.00065–0.00066 | 1717 |
| 60 | 0.00031–0.00032 | 2473 |
| Isosceles Triangle (β = 80°, γ = 80°); | | |
| a = 30 cms | 0.0021–0.0022 | 1276 sq cms |
| 40 | 0.00067–0.00068 | 2269 |
| 50 | 0.00026–0.00027 | 3545 |
| 60 | 0.00013–0.00014 | 5104 |
| Right-angled Triangle (β = 90°, γ = 45°); | | |
| a = 30 cms | 0.009–0.012 | 450 sq cm |
| 40 | 0.0032–0.0033 | 800 |
| 50 | 0.0013–0.0014 | 1250 |
| 60 | 0.00063–0.00064 | 1800 |
| Right-angled Triangle (β = 90°, γ = 60°); | | |
| a = 30 cms | 0.0040–0.0041 | 779 sq cm |
| 40 | 0.0012–0.0013 | 1386 |
| 50 | 0.00056–0.00057 | 2165 |
| 60 | 0.00025–0.00026 | 3118 |

TABLE 4

Predicted values of k at the first resonant frequency of a square panel whose sides are of length a when m = 12.

| | k at resonance | Panel area |
|---|---|---|
| a = 20 cms | 0.0075–0.0076 | 400 sq cms |
| 30 | 0.0015–0.0016 | 900 |
| 40 | 0.00047–0.00048 | 1600 |
| 50 | 0.00019–0.00020 | 2500 |
| 60 | 0.00009–0.00010 | 3600 |

Equation for Deflection of a Vibrating Panel

If one side of a thin elastic plate of thickness 2H and density ρ is subjected to a pressure P(x,y,t) per unit area the deflection W(x,y,t) of the plate satisfies the following partial differential equation [A. E. H. Love, A Treatise on the Mathematical Theory of Elasticity, 4th edition, Dover, p. 488 and p. 498].

$$D\,\mathrm{div}^4 W + 2\rho H \partial^2 W/\partial t^2 = P(x,y,t) \qquad [1]$$

where $\mathrm{div}^4=(\partial^2/\partial x^2+\partial^2/\partial y^2)^2$, D $2EH^3/3(1-\sigma^2)$ is the flexible rigidity of the plate, E is Young's modulus of elasticity and a is Poisson's ratio. In addition to satisfying the partial differential equation the function W(x,y,t) must satisfy the appropriate boundary conditions for x, y and t.

When there is no pressure p(x,y,t) applied to the plate the equation becomes $$D\,\mathrm{div}^4 W + 2\rho H \partial^2 W/\partial t^2 = 0 \qquad [2]$$

and any solution of this equation represents a free vibration such as occurs if the plate is depressed and then released.

If W(x,y,t) satisfies equation [1] and $W_1$(x,y,t) satisfies equation [2] then W(x,y,t)+$W_1$(x,y,t) also satisfies [1]. The W(x,y,t) may be chosen to be zero whenever there is no applied pressure P(x,y,t). The solution then consists of a portion dependent on P(x,y,t) and a further portion that is a free vibration initiated independently of the pressure P(x,y,t).

The present analysis is concerned with determination of the solution that is dependent on the pressure P(x,y,t) and ignores any free vibrations independent of P(x,y,t).

If the pressure applied to the plate is time dependent through the function cos[2π(1000f)t], which has a frequency of f KHZ, then P(x,y,t) may be replaced by P(x,y)cos[2π(1000f)t] and W(x,y,t) may be replaced by W(x,y)cos[2π(1000f)t] where W(x,y) satisfies the equation $$\mathrm{div}^4 W - Kf^2 W = P(x,y)/D \qquad [3]$$

where $$K=10^6\times 12\pi^2(1-\sigma^2)\rho/(EH^2)$$

and has the dimensions of $T^2/L^4$. The dimensions of D and E are $ML^2/T^2$ and $M/LT^2$ respectively. Each term in equation [3] has the dimensions of $L^{-3}$.

The equation [3] may be written in a more convenient form for computation by defining functions w[h,v], p[h,v] and a constant k so that $$W(x,y) = \frac{w(x,y)}{D_{PO}},$$

$$k=10^6[12\pi^2(1-\sigma^2)\rho/E]f^2/H^2$$

where $_{PO}$ is the pressure at some point, such as the centre, of the plate. Equation [3] may then be expressed in the form $$\mathrm{div}^4 w - kw = p(x,y) \qquad [4]$$

For steel the values of some of the constants, based on the metric system, are as follows [A. E. H. Love, p.105]. ρ=7.85, E =2×10$^{12}$, σ=0.27. Thus for a steel plate of thickness 0.2 cms (H=0.1) then K=0.0431, D=1.44×10$^9$, k=0.000431 (f/H)$^2$ and so for a steel plate some values of k are as listed in Table 2.

For aluminum the values of ρ, E, σand k are as follows ρ=2.7, E=0.7×10$^{12}$, σ=0.33, k=0.000407(f/H)$^2$ It follows that in order to use Table 2 for an aluminum panel the tabulated frequencies should be multiplied by 1.03.

Finited Difference Equations for a Rectangular Panel

Figure 10:
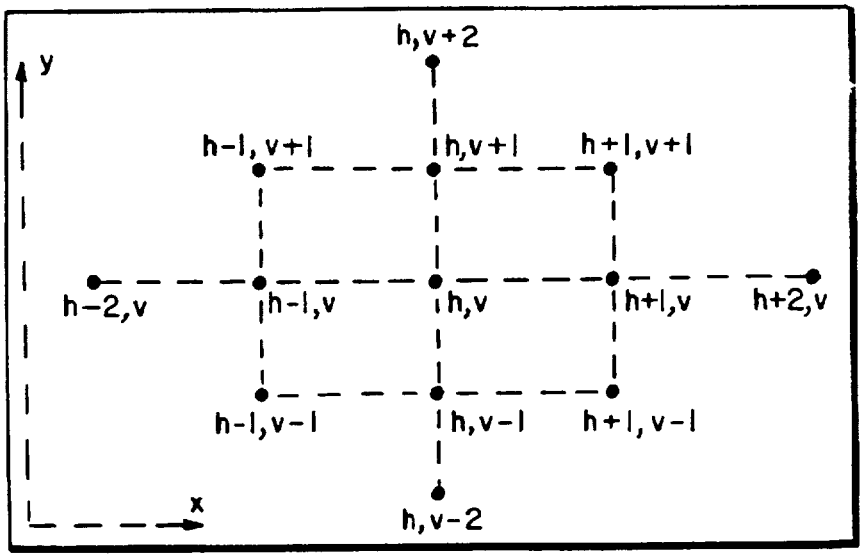
FIG. 10 is a graphical representation of points selected from a rectangular grid.

Consider a set of points chosen from a rectangular grid and labeled as shown in FIG. 10. The horizontal and vertical spacings are respectively a/m and b/n where a and b denote the total width and height of the grid and m and n are the number of subdivisions in the x and y directions. For any integers h and v the value of w(a/m,vb/n) will be denoted by w[h,v] where h and v range from 0 to m and 0 to n respectively.

At the point (h,v) the derivatives of the function w(x,y) may be approximated by differences as follows.

At $(h+1/2,v)$: $\partial w/\partial x = (m/a)\,(w[h+1,v] - w[h,v])$

At $(h-1/2,v)$: $\partial w/\partial x = (m/a)\,(w[h,v] - w[h-1,v])$

At $(h,v)$: $\partial^2 w/\partial x^2 = (m/a)^2(w[h+1,v] - 2w[h,v] + w[h-1,v])$ $\partial^2 x/\partial y^2 = (n/b)^2(w[h,v+1] - 2w[h,v] + w[h,v-1])$ $$\partial^4 w/\partial x^4 = (m/a)^4(w[h+2,v] - 4w[h+1,v] + 6w[h,v] - 4w[h-1,v] + w[h-2,v])$$

$$\partial^4 w/\partial y^4 = (n/b)^4(w[h,v+2] - 4w[h,v+1] + 6w[h,v] - 4w[h,v-1] + w[h,v-2])$$

$$\partial^4 w/\partial x^2\partial y^2 = (m^2n^2/a^2b^2)\,(w[h+1,v+1] - 2w[h+1,v] + w[h+1,v-1] - 2(w(h,v+1] - 2w2[h,v] + w[h,v-1]) + w[h-1,v+1] - 2w[h-1,v] + h[h-1,v-1]$$

$$div^4 w = [6(m/a)^4 + 8(m/a)^2(n/b)^2 + 6(n/b)^4]w[h,v] - 4[(m/a)^4 + (m/a)^2(n/b)^2]\,(w[h+1,v] + w[h-1,v]) - 4[(n/b)^4 + (m/a)^2(n/b)^2]\,(w[h,v+1] + w[h,v-1]) + 2(m/a)^2(n/b)^2(w[h+1,v+1] + w[h+1,v-1] + w[h-1,v+1] + w[h-1,v-1]) + (m/a)^4(w[h+2,v] + w[h-2,v]) + (n/b)^4(w[h,v+2] + w[h,v-2])$$

If b/a is denoted by s then $div^4w$ may be expressed in the form $$a^4 div^4 w = [6m^4 + 8m^2n^2/s^2 + 6n^4/s^4]w[h,v] - 4(m^4 + m^2n^2/s^2)\,(w[h+1,v] + w[h-1,v]) - 4[(n/s)^4 + m^2n^2/s^2]\,(w[h,v+1] + w[h,v-1]) + 2m^2n^2/s^2(w[h+1,v+1] + w[h+1,v-1] + w[h-1,v+1] + w[h-1,v-1]) + m^4(w[h+2,v] + w[h-2,v]) + n^4/s^4(w[h,v+2] + w[h,v-2])$$

If n/sm is denoted by r then $$(a/m)^4 div^4 w = [6 + 8n^2/(m^2s^2) + 6n^4/(m^4s^4)]w[h,v] + c_{10}(w[h+1,v] + w[h-1,v]) + c_{01}(w[h,v+1] + w[h,v-1]) + c_{11}(w[h+1,v+1] + w[h+1,v-1] + w[h-1,v+1] + w[h-1,v-1]) + c_{20}(w[h+2,v] + w[h-2,v]) + c_{02}(w[h,v+2] + w[h,v-2])$$

where $c_{10}=-4[1+r^2]$, $c_{01}=-4r^2[1+r^2]$, $c_{11}=2r^2$, $c_{20}=1$, $c_{02}=r^4$ Therefore $$(a/m)^4 \mathrm{div}^4 w = [6+8n^2/(m^2s^2)+6n^4/(m^4s^4)]w[h,v] - c_{10}w_{10}[h,v] - c_{01}w_{01}[h,v] + c_{11}w_{11}[h,v] + c_{20}w_{20}[h,v] + c_{02}w_{02}[h,v]$$

where $w_{10}[h, v]=w[h+1, v]+w[h-1, v]$ $w_{01}[h, v]=w[h, v+1]+w[h, v-1]$ $w_{11}[h, v]=w[h+1, v+1]+w[h+1, v-1]+w[h-1, v+1]+w[h<1, v-1]$ $w_{20}[h, v]=w[h+2, v]+w[h-2, v]$ $w_{02}[h, v]=w[h, v+2]+w[h, v-2]$ If the above expression for $div^4$ is substituted into the partial differential equation [4] the equation may be rewritten as a set of difference equations expressed as follows in which h and v range over all possible values for the grid.

$$[6 + 8n^2/(m^2s^2) + 6n^4/(m^4s^4)]w[h,v] + c_{10}w_{10}[h,v] + c_{01}w_{01}[h,v] + c_{11}w_{11}[h,v] + c_{20}w_{20}[h,v] + c_{02}w_{02}[h,v] - (a/m)^4(p[h,v] + kw[h,v]) = 0 \quad [5]$$

If g is defined as $$\frac{1}{6 + 8n^2/(m^2s^2) + 6n^4/(m^4s^4) - (a/m)^4\mathbf{k}}$$

then equation [5] may also be expressed in the form $$w[h,v] = g((a/m)^4P[h,v]) - c_{10}w_{10}[h,v] - c_{01}w_{01}[h,v] + c_{11}w_{11}[h,v] + c_{20}w_{20}[h,v] + c_{02}w_{02}[h,v]) \quad [6]$$

Figure 11:
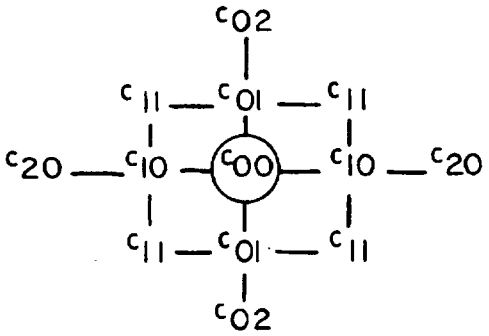
FIG. 11 is a generalized stencil.

In equation [5] the multipliers of the terms that represent $div^4w$ may be represented by the "stencil" 7 shown in FIG. 11 in which $c_{00}$ denotes $6+8\,n^2/(m^2s^2)+6n^4/(m^4s^4)$.

Figure 12:
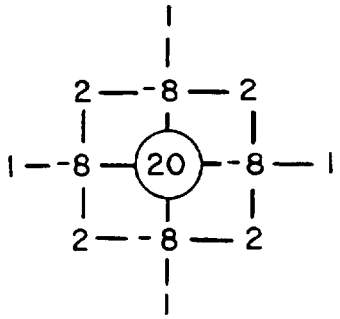
FIGS. 12, 13 and 14 are stencils for a square grid.

In the special instance of a square plate with grid points chosen so that s=1 and n=m the equation [5] reduces to $$20w[h,v] - 8\{w(h+1,v) + w(h-1,v) + w(h,v+1) + w(h,v-1)\} + 2[w[h+1,v+1] + w[h-1,v+1] + w[h+1,v-1] + w[h-1,v-1]] + [w(h+2,v) + w[h-2,v] + w[h,v+2] + w[h,v-2]] - (a/m)^4[p[h,v] + kw[h,v]] = 0$$

and the corresponding stencil is shown in FIG. 12.

Figure 13:
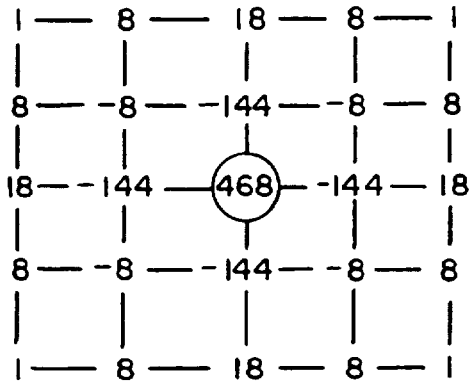

As discussed by W. E. Milne, Numerical Solution of Differential Equation, 2nd edition, Dover, 1970, p.226, a more accurate representation of $div^4$ for a square grid is according to the stencil shown in FIG. 13.

Figure 14:
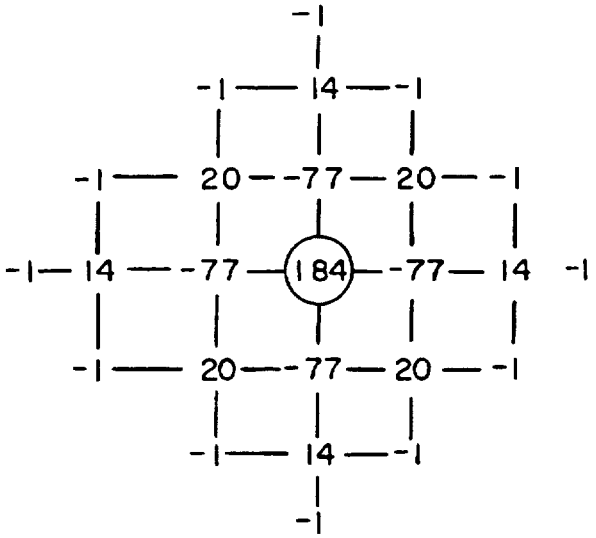

M. G. Salvadori and M. L. Baron, Numerical Methods in Engineering, Prentice Hall, 1952, p. 197 list the stencil shown in FIG. 14 for representation of $6div^4$ for a square grid.

Figure 15:
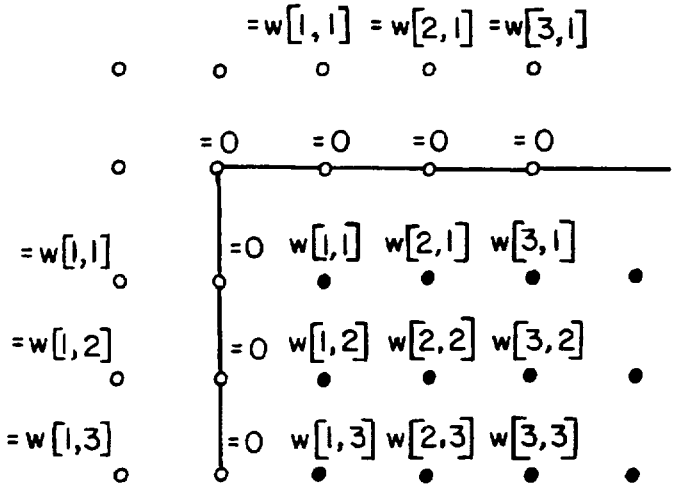
FIG. 15 illustrates grid points near the upper left corner of a rectangular plate with horizontal clamped edges.

Suppose the different equations with $div^4$ represented by the stencil 7 of FIG. 11 are applied at each point of a grid for a rectangular plate whose edges are clamped to be horizontal. A corner of the plate is shown in FIG. 15. Since there is no deflection at the edges then w[0,v]=w[h,v]=0 for all values of h and v. Similarly w[m,v]=w[h,n]=0 for all h and v. The condition for zero slope at right angles to each edge of the plate may be set by assuming the grid to extend beyond each edge of the plate for a further grid interval and setting the deflections at the extended grid points as shown in FIG. 15.

Figure 16:
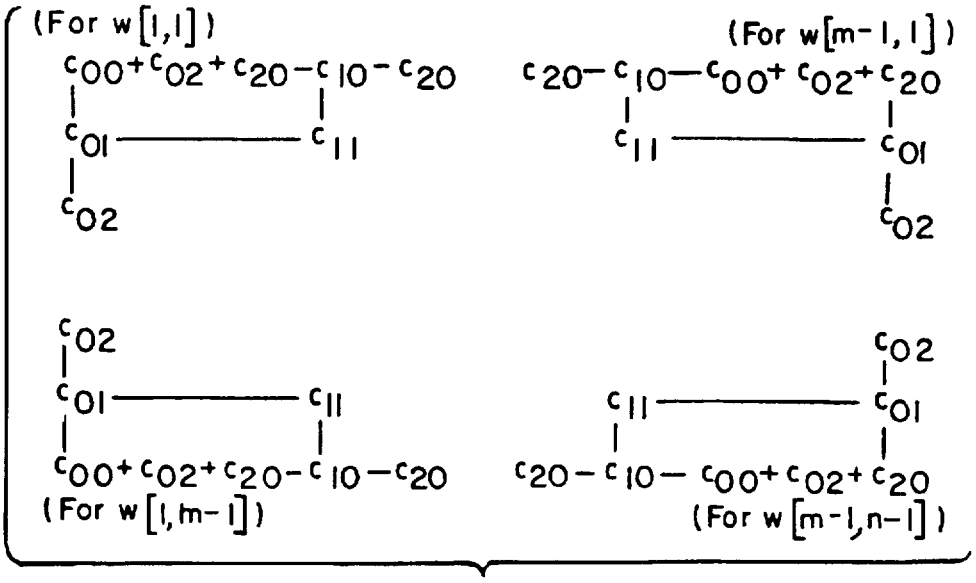
FIG. 16 are schematic illustrations of stencils for grid points at one grid length from the corners of a rectangular plate with horizontal clamped edges.

When equation [5] is applied with [h,v]=[1,1] the terms that represent $div^4$ w are $$c_{02}w[1,1] + c_{20}w[1,1] + c_{00}w[1,1] + c_{10}w[2,1] + c_{20}w[3,1] + c_{01}w[1,2] + c_{11}w[2,2] + c_{02}w[1,3]$$

which correspond to the stencil for w[1,1] shown in FIG. 16. The other stencils are for the points in corresponding positions near the other corners of the plate.

Figure 17:
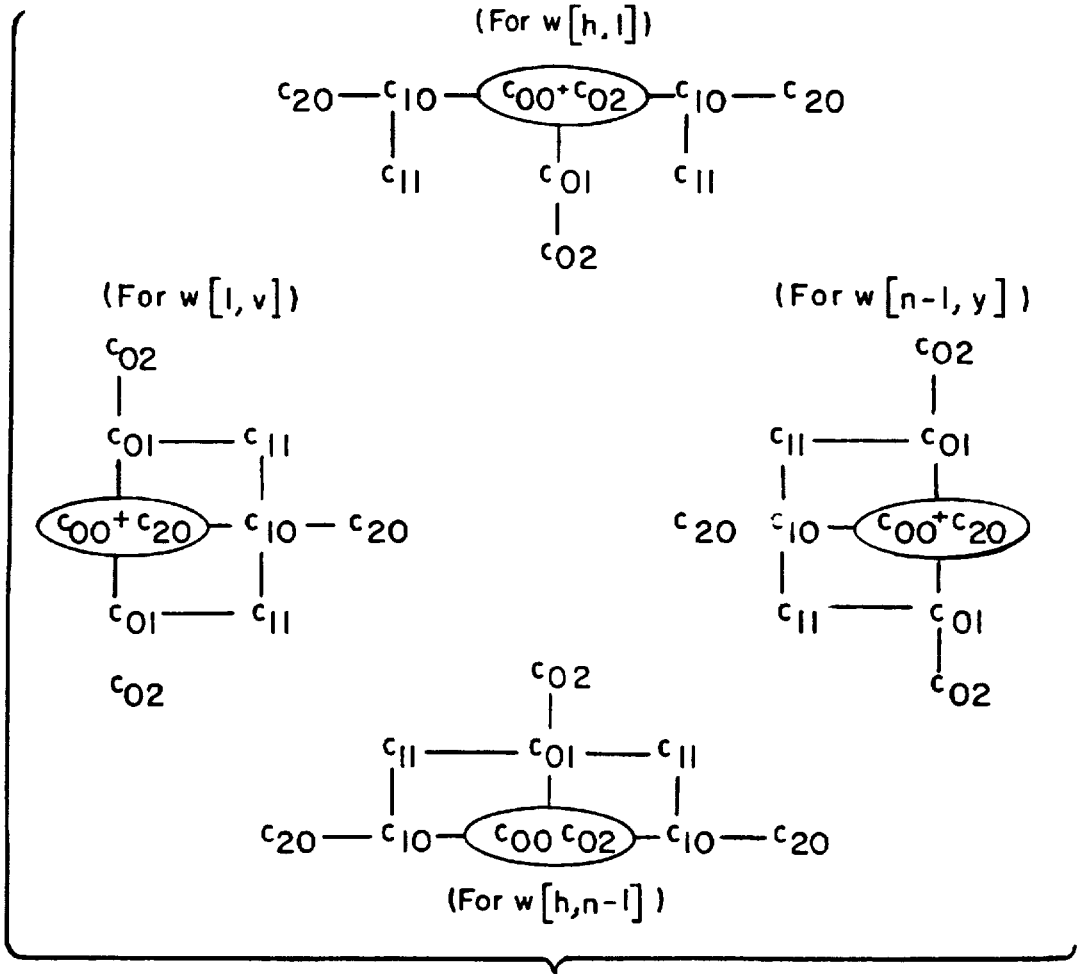
FIG. 17 are schematic illustrations of stencils for grid points at one grid length from the edges of rectangular plate with horizontal clamped edges.

Similar stencils for other points that are one grid length from the edge of the plate but are not w[1,1], w[m−1,1], w[1,n−1] or w[m−1,n−1] are as shown in FIG. 17.

Figures 18A, 18B, 18C:
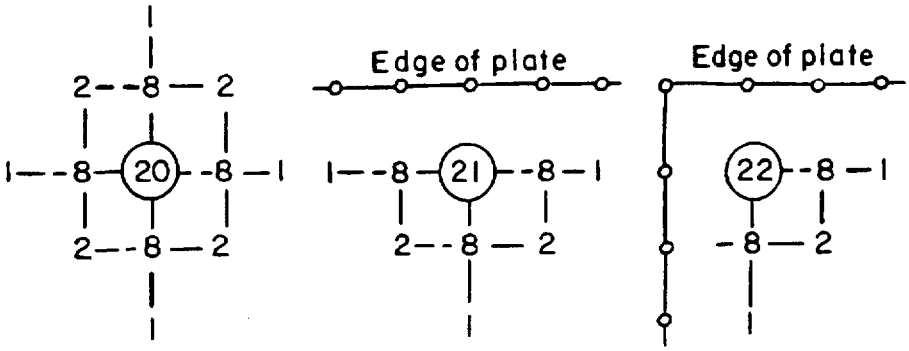
FIGS. 18(*a*), (*b*) and (*c*) are stencils for a square grid with horizontal clamped edges.

For a square grid the FIGS. 12, 16 and 17 may be summarized as in FIG. 18*a*, *b*, *c* below.

If the edges of the plate are horizontal but freely supported then in FIG. 15 the values of w at the extended grid points should be set equal to $-w[1,1]$ etc. and so the stencils of FIGS. 16 and 17 should be modified as follows.

In FIG. 16: Replace $c_{00}+c_{02}+c_{20}$ by $c_{00-c02}-c_{20}$

In FIG. 17: Replace $C_{00}+c_{02}$ by $c_{00-c02}$

Replace $c_{00+c20}$ by $c_{00-c20}$

Suppose the edges of the plate are semi-fixed in the sense of being restrained but not rigidly clamped. Such a situation may be simulated by supposing the extended grid points in FIG. 15 to have deflections that are a fixed proportion, say f, of the deflections $w[1,1]$ etc. The value of f must be in the range $-1<f<1$. The stencils of FIGS. 16 and 17 should then be modified as follows.

In FIG. 16: Replace $c_{00}+C_{02}+c_{20}$ by $c_{00+fc02}+fc_{20}$

In FIG. 17: Replace $c_{00+c02}$ by $c_{00+fc02}$

Replace $c_{00+c20}$ by $c_{00}+fc_{20}$

Finite Difference Equations for a Triangular Panel

Figure 19:
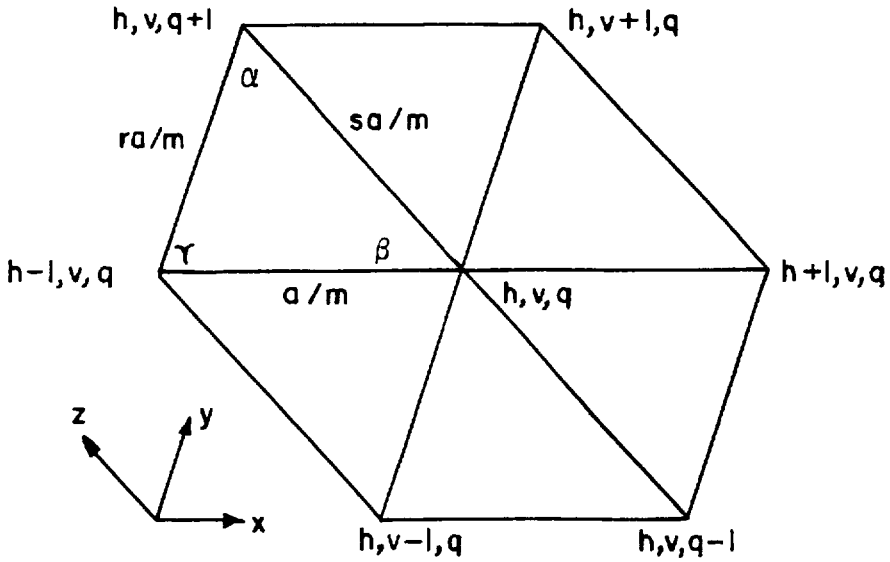
FIG. 19 is a graphical illustration of the labelling of points in a triangular grid.

A triangle whose sides are of lengths a, ra and sa may be subdivided into a grid of m smaller triangles whose sides have lengths a/m, ra/m and sa/m. Consider a set of points chosen from the triangular grid and labeled as in FIG. 19. The values of h, v and q each range from 0 to m. The coordinates x, y and z are not independent. The values of h, v and q each range from 0 to m and are not unique. Thus h, v+1,q−1 =h+1,v,q and h,v−1,q+1 =h−1,v,q.

Salvadori and Baron, p. 245, derive an expression for $div^2$ in terms of triangular coordinates. Using the notation of FIG. 19 their expression may be written in the form $$div^2w = \frac{[(\sin 2\alpha)\partial^2 w/\partial x^2 + (\sin 2\beta)\partial^2 w/\partial y^2 + (\sin 2\gamma)\partial^2 w/\partial z^2]}{(2\sin\alpha\sin\beta\sin\gamma)}$$

If the derivatives in the different directions are approximated by the differences listed above then $$\begin{aligned}(a/m)^2 div^2 w &= \frac{\sin 2\alpha}{2\sin\alpha\sin\beta\sin\gamma}(w[h+1,v,q] - 2w[h,v,q] + w[h-1,v,q]) + \\ &\quad \frac{\sin 2\beta}{2r^2\sin\alpha\sin\beta\sin\gamma}(w[h,v+1,q] - 2w[h,v,q] + w[h,v-1,q]) + \\ &\quad \frac{\sin 2\gamma}{2s^2\sin\alpha\sin\beta\sin\gamma}(w[h,v,q+1] - 2w[h,v,q] + w[h,v,q-1] \\ &= c_{000}w[h,v,q] + \\ &\quad c_{100}(w[h+1,v,q] + w[h-1,v,q]) + \\ &\quad c_{010}(w[h,v+1,q] + w[h,v-1,q]) + \\ &\quad c_{001}(w[h,v,q+1] + w[h,v,q-1])\end{aligned}$$

where $$c_{000} = -[\sin 2\alpha + (\sin 2\beta)/r^2 + (\sin 2\gamma)/s^2]/(\sin\alpha\sin\beta\sin\gamma) \quad (= -4 \text{ if } \alpha=\beta=\gamma=60°)$$

$$c_{100} = \frac{\sin 2\alpha}{2\sin\alpha\sin\beta\sin\gamma} \quad (= 2/3 \text{ if } \alpha=\beta=\gamma=60°)$$

$$c_{010} = \frac{\sin 2\beta}{2r^2\sin\alpha\sin\beta\sin\gamma} \quad (= 2/3 \text{ if } \alpha=\beta=\gamma=60°)$$

$$c_{001} = \frac{\sin 2\gamma}{2s^2\sin\alpha\sin\beta\sin\gamma} \quad (= 2/3 \text{ if } \alpha=\beta=\gamma=60°)$$

Figure 20:
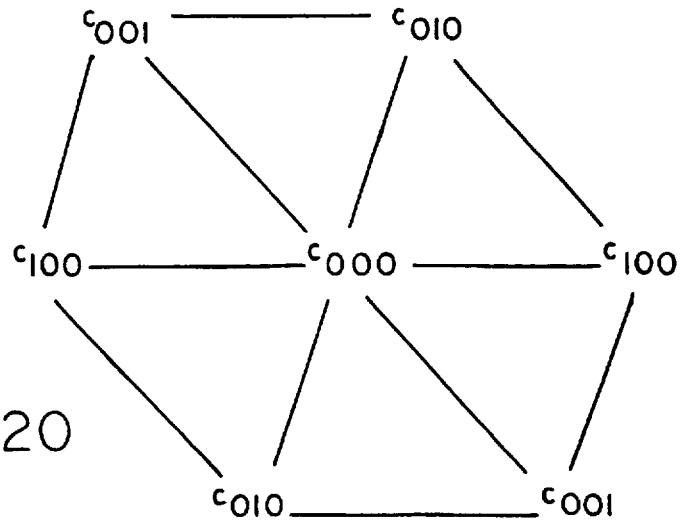
FIG. 20 is a stencil for a triangular grid.

Thus $(a/m)^2\ div^2w$ may be represented by the stencil shown in FIG. 20.

Figure 21:
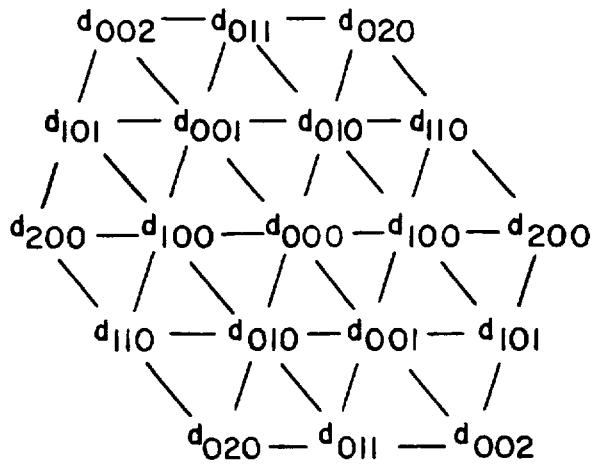
FIG. 21 is a stencil for a triangular grid.

If the stencil of FIG. 20 is then applied to the function $div^2w$ there results the stencil shown in FIG. 21 for (a/m) $^4div^4w$ in which the values of the $d_{000}$ etc. are as follows. The values shown in the | | brackets are those that result when a $\alpha=\beta=\gamma=60°$ $$d_{000} = c_{000}^2 + 2c_{100}^2 + 2c_{010}^2 + 2c_{001}^2 \qquad [168/9]$$

$$d_{100} = 2c_{000}c_{100} + 2c_{010}c_{001} \qquad [-40/9]$$

$$d_{200} = c_{100}^2 \qquad [4/9]$$

$$d_{110} = 2c_{100}c_{010} \qquad [8/9]$$

with similar equations obtained by permutation of the indices.

Figure 22:
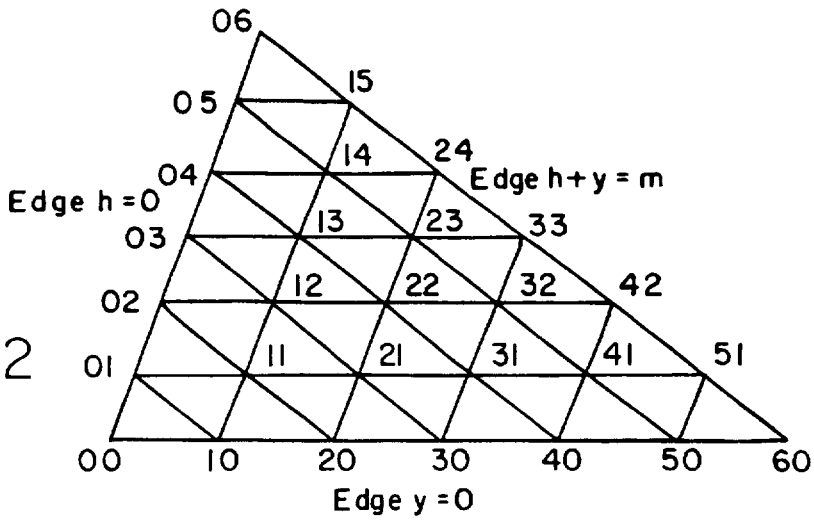
FIG. 22 is a schematic diagram of a triangular plate covered by a grid with m=6.
Figure 23:
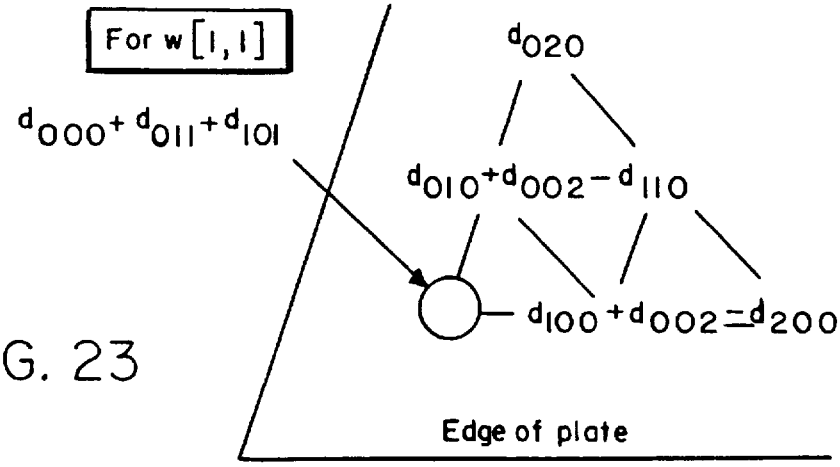
FIGS. 23–30 are illustrations of stencils with respect to the triangular plate of FIG. 22.
Figure 24:
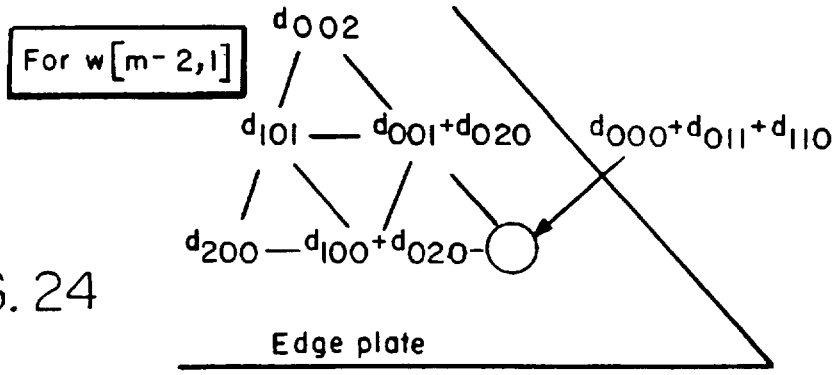
Figure 25:
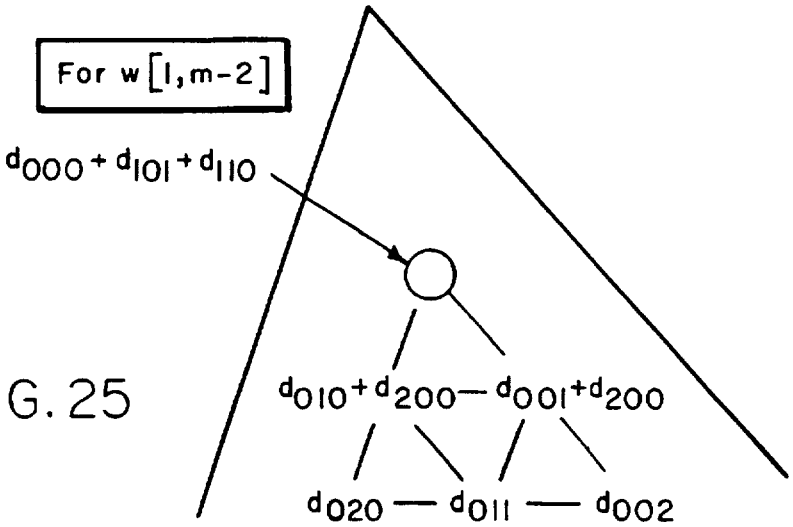
Figure 26:
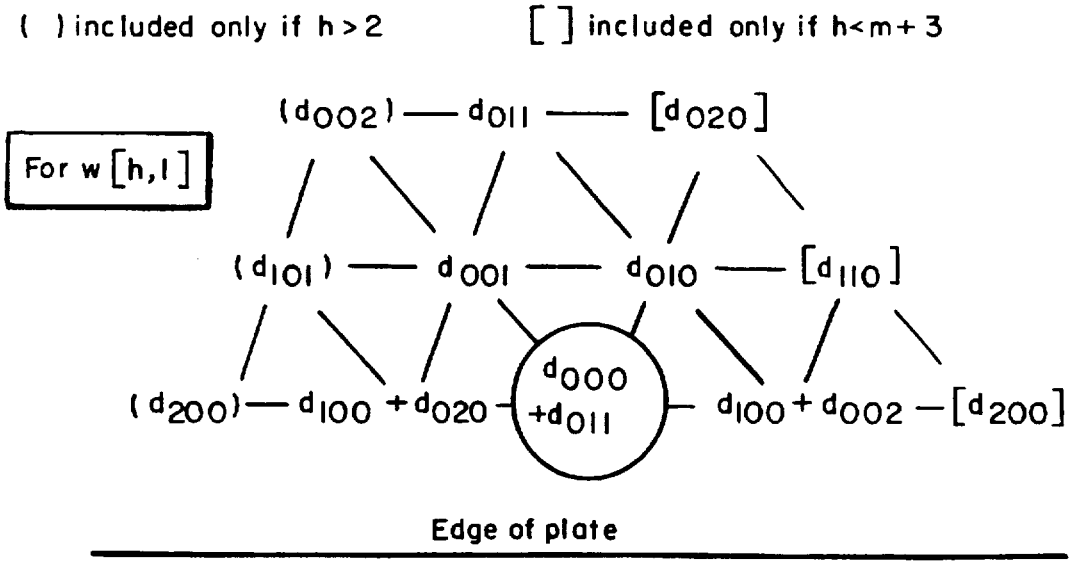
Figure 27:
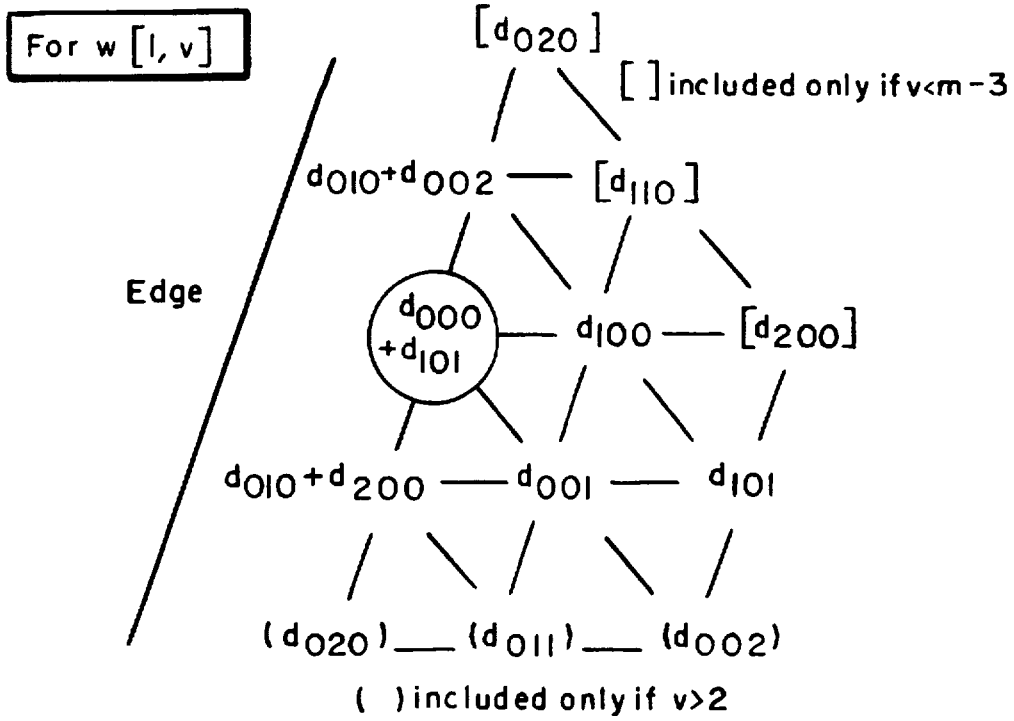
Figure 28:
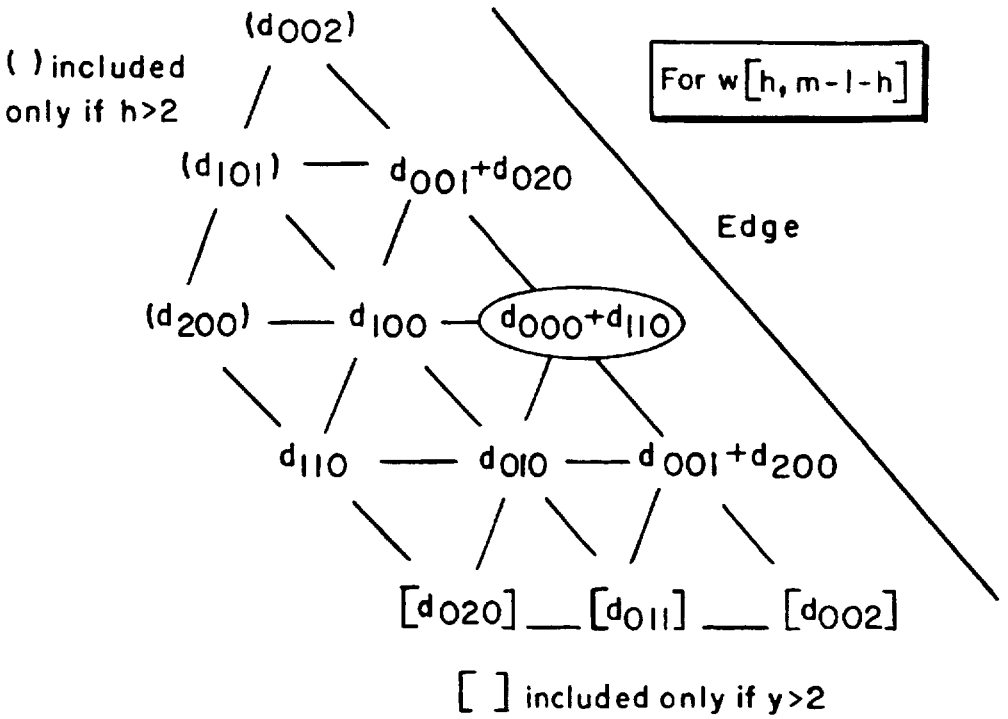
Figure 29:
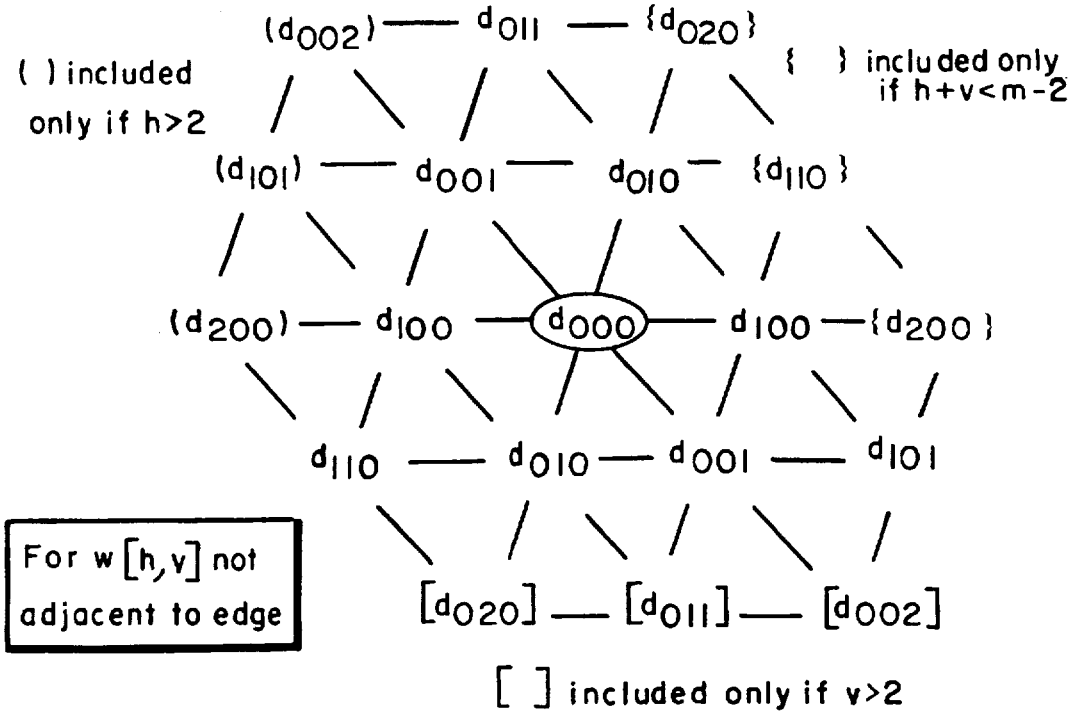

Suppose the difference equations are applied to a triangular plate whose edges are horizontally clamped. When m=6 the grid points are as shown in FIG. 22. The labeling of the points assumes that q=0. The three edges of the plate may be specified by the three equations h=0, v=0, and h+v=m (=6).

The condition for zero slope at right angles to each edge may be set by assuming the grid to extend beyond each edge for a further grid interval and setting the deflections at the extended grid points to be the same as at the corresponding grid points that are one grid interval inside the triangular plate. This implies that $$w[-1,1]=w[1,-1]=0$$

$$w[-1,m]=w[1,m]=0$$

$$w[m,-1]=w[m,1]=0$$

As discussed above, the stencils for some of the grid points within the triangular plate may be modified to reflect the imposed boundary condition. However, in contrast to the rectangular plate the line connecting the opposite points is not at right angles to the plate unless the plate is an isosceles or equilateral triangle. The condition could be modified to give a better approximation but has not been for the calculations described below. The resulting stencils are shown in FIGS. 23–29.

If the edges of the plate are semi-fixed through a factor f as described above or are simply supported (f=1) then in the above stencils the terms added to $d_{00}$ $d_{100}$ or $d_{010}$ should be multiplied by the factor f.

Figure 30:
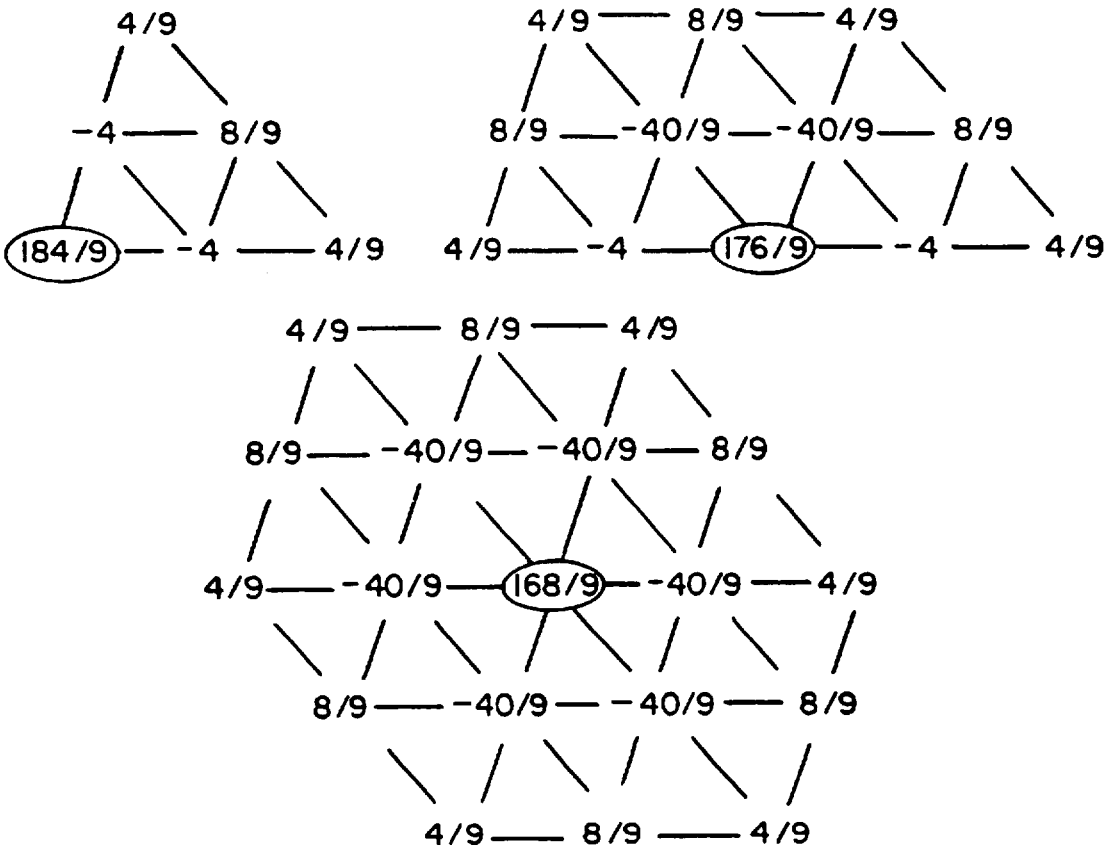

For an equilateral grid the above stencils may be summarized as shown in FIG. 30.

Note on Program Details and Accuracy of the Predictions

The difference equations [5] for a square panel, and the corresponding difference equations for a triangular panel, have been solved for various dimensions and values of k. The method uses a Macintosh IIsi computer and a Wingz spreadsheet in which the data is entered as follows:

For a triangular plate the values of a, β, γ, m and k are entered into cells D1 to H1. A program written in the HyperScript language is then called to display the plate area and various coefficients in cells L3 to AE, compute the coefficients of the m(m−1)/2 linear equations, to invert the resulting matrix, and to store the resulting deflections in column 1. Using successive sets of data the computation may be repeated and the new deflections placed in columns 2, 3, etc.

For a square plate the values of a, b, m, n and k are entered into cells A3 to E3, and a different HyperScript program is called. The deflections are placed to the right of the matrix elements.

The precision of the computations is such that round-off error is negligible. Any error is caused by the use of a finite size for the grid for the finite difference approximations.

In order to check the accuracy of the computations they were performed for a square plate with a=b=10 and k=0. The case k=0 corresponds to deflection by a load that does not vary with time and hence there is no vibration. The computed deflection w at the center of the panel is shown in Table 5 for several values of m. Salvadori and Baron, p.270, have also performed the computations for k =0 and m =8. Their computed deflection at the center of the plate agrees with that obtained in the present work. They state that the value obtained when m=8 is 13% higher than the more accurate series solution given by Timoshenko, which corresponds to a center deflection of 12.79. The percentage errors listed in Table 5 are with respect to the supposed exact value of 12.79. It is believed that the deflections obtained by use of m=16 would be sufficiently accurate for the present study.

TABLE 5

Accuracy of computed deflection at the center of a rectangular platewith sides of length 10 cms

| | | | | |
|---|---|---|---|---|
| m = | 4 | 8 | 12 | 16 |
| w = | 18.0 | 14.4 | 13.39 | 13.07 |
| % Error = | 43% | 13% | 4.7% | 2.2% |
| No. Eqns. = | 9 | 49 | 121 | 225 |
| Time = | <1 sec | 10 secs | 5 mins | 1 hour |

The following remarks describe the method that was used to derive the resonant values of k listed in Table 3.

For a panel in the form of an equilateral triangle with sides of length a=40 cms the value of m was first chosen as 12, and several values of k were chosen to determine a value of k, say k1, that led to a very large positive deflection. Then several values of k were chosen to determine a larger value, say k2, that led to a large negative deflection. The two values of k were then used with m=16 and adjusted, if necessary, in order to ensure that k1 led to a large positive deflection and k2 led to a large negative deflection with m=16. The process was repeated with m=20. The large deflections and corresponding values of k1 and k2 were as shown in Table 6.

TABLE 6

Successive values of k1 and k2 for an equilateral triangular panel with a = 40 cms, the deflections d1 and d2 are at the center of the panel

| m | k1 | d1 | k2 | d2 |
|---|---|---|---|---|
| 12 | 0.0032 | 66323 | 0.0033 | −23569 |
| 16 | 0.0034 | 10107 | 0.0035 | −12822 |
| 20 | 0.0035 | 18955 | 0.0036 | −176105 |

Conclusion

It is thus seen that the combination of stiffened plates interconnected resiliently to form a cavity for receiving sound absorbing materials with or without a septum structure results in a sound attenuating structure able to suppress the transmission of noise, particularly noises in the frequency range of 125 Hz to 4,000 Hz. The stiffened plates include stiffening members arranged in a geometrical pattern forming triangles selected to eliminate low frequency resonances. The structures of the invention can be configured as doors for use in radio studios, television studios, concert halls, auditoria of all types, public rooms, libraries, multiple dwellings, external doors in homes, machinery rooms of all types, office suites, and high security areas. Importantly, unlike prior art sound attenuating doors, the structures of the present invention do not utilize any hazardous materials such as lead and other heavy metals. It is noted that the sound attenuating structures of the present invention, in addition to being used as door panels, may also function as fixed panels or partitions between building spaces.

It is intended that all modifications and variations of the disclosed invention be included within the scope of the appended claims.

What is claimed is:

1. Sound attenuating structure comprising:

spaced apart first and second stiffened metal panels, each metal panel including a metal plate and stiffening elements affixed to the metal plate and disposed in a geometric grid pattern, the geometric grid pattern comprising horizontally disposed bars and vertically disposed bars to form squares or rectangles and diagonal bars disposed along diagonals of the squares or rectangles to form triangular regions;

a spring connection structure adapted to connect the first and second stiffened panels to form a sealed cavity therebetween; and a sound attenuating material disposed within the cavity.

2. The sound attenuating structure of claim 1 further including a septum disposed between the first and second metal panels.

3. The sound attenuating structure of claim 2 wherein the septum is a metal plate.

4. The sound attenuating structure of claim 2 wherein the septum comprises a metal plate and wallboard material, the wallboard material flanking the metal plate.

5. The sound attenuating structure of claim 1 wherein the sound attenuating material is a non-continuous material.

6. The sound attenuating structure of claim 5 wherein the non-continuous material is a porous material.

7. The sound attenuating structure of claim 6 wherein the porous material is rock wool.

8. The sound attenuating structure of claim 1 wherein the stiffening elements comprise bars selected to limit panel resonances to frequencies above approximately 1500 Hz.

9. The sound attenuating structure of claim 1 wherein the panels are connected using a combination of silicone and mechanical welds.

10. The sound attenuating structure of claim 1 or claim 2 further including endplates disposed between the first and second metal panels and connected through a spring connection to the first and second metal panels.

11. The sound attenuating structure of claim 1 wherein the stiffened metal panels are coated with a vibration damping material.

12. The sound attenuating structure of claim 1 wherein area of the triangular regions is maximized while eliminating resonances in a desired frequency range whereby the amount of the stiffening elements is reduced.

13. The sound attenuating structure of claim 1 wherein the geometric grid pattern on the first panel is rotated with respect to the geometric grid pattern on the second panel.

14. The sound attenuating structure of claim 13 wherein the geometric grid pattern on the first panel is rotated by ninety degrees with respect to the geomtric grid pattern on the second panel.

* * * * *

UNITED STATES PATENT AND TRADEMARK OFFICE

CERTIFICATE OF CORRECTION

PATENT NO. : 5,777,279

DATED : July 7, 1998

INVENTOR(S) : Murray M. Parker and Arthur J. Hustins, Jr.

It is certified that error appears in the above-identified patent and that said Letters Patent is hereby corrected as shown below:

Column 10, line 37: after "$W(x,y) = \frac{w(x,y)}{D_{PO}}$,", insert -- P(x,y) = p(x,y) /PO, --.

Column 10, line 63: after; "w(" insert -- h --.

Signed and Sealed this

Twenty-fourth Day of November, 1998

*Attest:*

BRUCE LEHMAN

*Attesting Officer*

*Commissioner of Patents and Trademarks*